US005569637A

United States Patent [19]

Cregg

[11] Patent Number: 5,569,637

[45] Date of Patent: Oct. 29, 1996

[54] FEATURING INFORMATION ON A RECORD USING COLOR

[75] Inventor: Martin S. Cregg, Onondaga County, N.Y.

[73] Assignee: Cullman Ventures, Inc., New York, N.Y.

[21] Appl. No.: 164,013

[22] Filed: Dec. 8, 1993

[51] Int. Cl.[6] ..... B41M 5/124

[52] U.S. Cl. ..... 503/201; 503/202; 503/204; 503/206; 503/226

[58] Field of Search ..... 503/201, 202, 503/204, 206, 226

[56] References Cited

U.S. PATENT DOCUMENTS

| | | | |
|---|---|---|---|
| 3,672,842 | 6/1972 | Florin | 23/230 |
| 4,037,007 | 7/1977 | Wood | 428/199 |
| 4,212,393 | 7/1980 | Lenkoff | 206/575 |
| 4,748,147 | 5/1988 | Sumi-i et al. | 503/204 |
| 4,889,559 | 12/1989 | Goldberg et al. | 106/21 |
| 5,139,572 | 8/1992 | Kawashima | 106/21 |
| 5,232,494 | 8/1993 | Miller | 106/22 B |

FOREIGN PATENT DOCUMENTS

| | | | |
|---|---|---|---|
| 2724820 | 3/1979 | Germany | 503/201 |
| 9311198 | 6/1993 | WIPO | 503/206 |
| 9406872 | 3/1994 | WIPO | 503/204 |

OTHER PUBLICATIONS

Wagner Abstract, DE 2530570 dated Mar. 29, 1984.
Wagner Abstract, DE 2523329 dated Mar. 29, 1986.
Crayola® Changeables™ Color Change Markers (box); 1992; Binney & Smith Inc.

*Primary Examiner*—Bruce H. Hess
*Attorney, Agent, or Firm*—Trapani & Molldrem

[57] ABSTRACT

In accordance with the present invention there is provided a system and method for featuring information on a record. The system and method utilize reactant and coreactant compositions which are formulated to produce a color-changing reaction when brought together. The system and method also utilize a record having first and second areas disposed adjacent to each other. The second area is generally treated with the reactant composition. The coreactant composition is formulated to exhibit a first marking color on the first area of the record and to produce a color-changing reaction with the reactant composition on the second area of the record. The color-changing reaction effects a second marking color on the second area. The system and method further utilize a writing implement containing the coreactant composition. The implement is used to deposit the coreactant composition on the first and second areas in the form of symbolic information. The information on the first area exhibits the first marking color, and the information on the second area exhibits the second marking color after the color-changing reaction has taken place. The result of carrying out the system and method of the present invention is that the information is featured on the record by the contrast between the first and second marking colors.

24 Claims, 7 Drawing Sheets

FEATURING INFORMATION ON A RECORD USING COLOR

BACKGROUND OF THE INVENTION

1. Technical Field

The present invention relates generally to articles on which a written account is made, such as: wall, desk and other calendars; telephone address books; student planners, specialized planners and business planners; record keeping books; budgeting books; diaries; daybooks; journals; registers; note pads; and the like. More particularly, the present invention relates to a system and method of featuring information recorded on such articles.

2. Background Art

The purpose of such articles as calendars, planners, diaries, daybooks, journals, registers, note pads and notebooks, is to: record facts, figures, events, ideas, tasks, conversations, commands, instructions, directions, and other information; and organize, plan and coordinate future tasks, events or assignments by date, time, place, subject matter and/or person. There is a need for a capability to efficiently manage all of this information once it has been recorded. Such information management includes: sorting through previously recorded information and locating what is pertinent for a particular instant; assigning priorities to planned tasks, events or assignments; and indicating that a particular item of information is no longer relevant, that a task has been completed, or an event has taken place.

Heretofore, there has been various attempts at providing information management tools and techniques which aid in sorting and locating, prioritizing, or indicating functions. For example, there have been efforts to divide the record-entry area into several sub-areas for designated categories of information (e.g., appointments, task lists, notes, expenses, etc.). Recent attempts to improve upon this technique have included adding a background color to one or more of the sub-areas to aid in locating or prioritizing categories of information. In addition, different colored pens, or pens having multiple cartridges holding different colored inks, have been considered. All of these techniques and tools have proven to be useful. However, the need still exists for more effective and simplified approaches to locating, prioritizing and marking previously recorded information. The present invention fulfills this need by featuring recorded information with color in a simplified and inconspicuous manner.

OBJECTS AND SUMMARY OF THE INVENTION

It is therefore an object of the present invention to provide systems and methods of featuring recorded information that improve upon the prior art and avoid the problems associated therewith.

It is another object of the present invention to provide systems and methods of featuring recorded information which facilitate the locating of pertinent entries.

It is a further object of the present invention to provide systems and methods of featuring recorded information which assist in prioritizing such information.

It is yet another object of the present invention to provide systems and methods of featuring recorded information to indicate such matters as, the relevance of information, the completion of tasks, and the occurrence of events.

It is yet a further object of the present invention to provide systems and methods of featuring recorded information which are uncomplicated and executed in an inconspicuous manner.

It is still another object of the present invention to provide systems and methods which feature recorded information in a neat and clear presentation.

These and other objects are attained in accordance with the present invention wherein there is provided a system for featuring information on a record. The system comprises reactant and coreactant compositions which are formulated to produce a color-changing reaction when brought together. The system also includes a record having first and second areas. The second area is generally treated with the reactant composition. The coreactant composition is formulated to exhibit a first marking color on the first area of the record and to produce a color-changing reaction with the reactant composition on the second area of the record. The color-changing reaction effects a second marking color on the second area. The system further includes a writing implement containing the coreactant composition. The implement is used to deposit the coreactant composition on the first and second areas in the form of symbolic information. The information on the first area exhibits the first marking color, and the information on the second area exhibits the second marking color after the color-changing reaction has taken place. The result of carrying out the system of the present invention is that the information is featured on the record by the contrast between the first and second marking colors.

Methods of featuring information on a record with a writing implement are also contemplated by the present invention. These methods comprise the steps of: (1) utilizing a record which has first and second areas disposed adjacent to each other, the second area being generally treated with a reactant composition; (2) utilizing a writing implement containing a coreactant composition, the coreactant composition being formulated to exhibit a first marking color on the first area of the record and to produce a color-changing reaction with the reactant composition on the second area of the record, the color-changing reaction effecting a second marking color on the second area; (3) applying the writing implement to the record, in the first area, to deposit the coreactant composition thereon in the form of symbolic information which exhibits the first marking color; and (4) applying the writing implement to the record, in the second area, to deposit the coreactant composition thereon in the form of symbolic information which exhibits the second marking color after the color-change reaction.

In another method of the present invention, there are the following steps: (1) utilizing a record which includes a first area generally treated with a first reactant composition and a second area generally treated with a second reactant composition; (2) utilizing a writing implement containing a coreactant composition, the coreactant composition being formulated to produce a first color-changing reaction with the first reactant composition and a second color-changing reaction with the second reactant composition, the first color-changing reaction effecting a first marking color on the first area of the record, and the second color-changing reaction effecting a second marking color on the second area of the record; (3) applying the writing implement to the record, in the first area, to deposit the coreactant composition thereon in the form of symbolic information which exhibits the first marking color after the first color-changing reaction; and (4) applying the writing implement to the record, in the second area, to deposit the coreactant composition thereon in the form of symbolic information which exhibits the second marking color after the second color-changing reaction.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENTS

Figure 1:
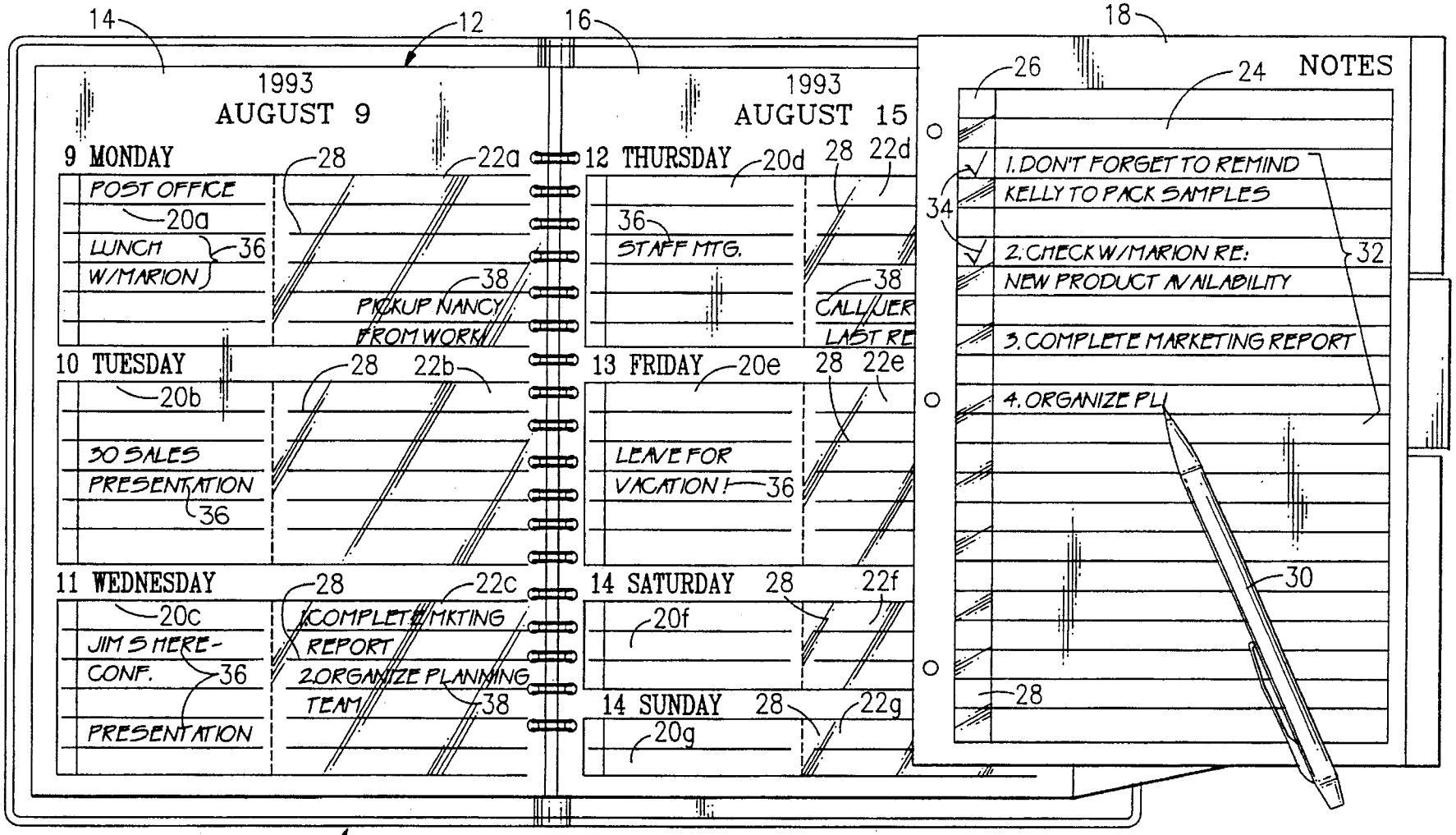
FIG. 1 is a top plan view of a wire bound "organizer" displaying a three-page record which includes two planning pages and a note pad page, and showing a writing implement, wherein the organizer and writing implement embody the teachings of the present invention.

Referring to FIG. 1, there is shown a top plan view of a wire bound "organizer" 10 embodying the teachings of the present invention. Organizer 10 opens up to display a record 12 which comprises two planning pages 14 and 16, and a note page 18 which is from a SpeedPage™ pull-out note pad (SpeedPage™ is a trademark of Keith Clark, Sidney, N.Y.). The term "record," as used in this application, shall mean any tangible substrate medium or system of substrate mediums suitable for entering written information thereon. Planning pages 14 and 16 collectively present the user with a one week planning calendar which includes ruled appointment areas 20*a–g* and ruled task ("to do") areas 22*a–g*. Note page 18 includes a ruled note area 24 and a ruled column area 26. Column area 26 may be used, for example, to enter information in the form of a check mark to provide an indication that a task has been performed or an event has taken place.

As shown in FIG. 1, task areas 22*a–g* and column area 26 are treated with a reactant composition 28. Reactant composition 28 contains a reactant substance which participates in a chemical reaction with a coreactant substance of a coreactant composition, resulting in a change in color of either the reactant composition or the coreactant composition. In the preferred embodiment, reactant composition 28 is a clear bleach solution and the coreactant composition is an ink formulation containing a bleach sensitive dye of one color and a bleach resistant dye of another color. These preferred compositions will be described in further detail below. In accordance with the present invention, the coreactant composition is contained in a writing implement 30 (See FIG. 1). In the preferred embodiment, implement 30 is a conventional fiber tip or roller ball pen.

As shown in FIG. 1, implement 30 is applied to area 24 and made to deposit the coreactant composition thereon in the form of symbolic information, such as a list of tasks 32. The coreactant composition is formulated to exhibit a first predetermined marking color (e.g., black) on those areas of record 12 that are not treated with reactant composition 28 (i.e., areas 20*a–g* and 24). Thus, list 32 exhibits this first predetermined marking color. The coreactant composition is also formulated to produce a color-changing reaction with reactant composition 28 to effect a second predetermined marking color on the entry areas treated with composition 28. It is preferred that the color-change reaction occur rapidly so that it is perceived as occurring almost instantaneously.

As suggested by FIG. 1, implement 30 has been applied to area 26, and has deposited the coreactant composition thereon in the form of symbolic information, such as check marks 34. The introduction of the coreactant composition on area 26 initiates a color-change reaction with composition 28, causing the color of the deposited coreactant composition to change to the second predetermined color (e.g., orange). Accordingly, check marks 34 exhibit this second color after the color-changing reaction has taken place. The information recorded on note page 18 is thus featured in two contrasting colors (e.g., black and orange), and provides a visual aid in indicating priority or status of select items in list 32.

With further reference to FIG. 1, textual information 36 has been recorded on areas 20*a–e* using implement 30. Since areas 20*a–e* are not treated with composition 28, text 36 exhibits the first predetermined marking color (e.g., black). On adjacent entry areas 22*a*, 22*c* and 22*d*, textual information 38 has been recorded using implement 30. Text 38 exhibits the second predetermined marking color because of a color-changing reaction between the deposited coreactant composition and reactant composition 28. The information recorded on planning pages 14 and 16 is thus featured in two contrasting colors (e.g., black and orange), and provides a visual aid in locating particular categories of information (i.e., scheduled appointments vs. tasks).

Figure 2:
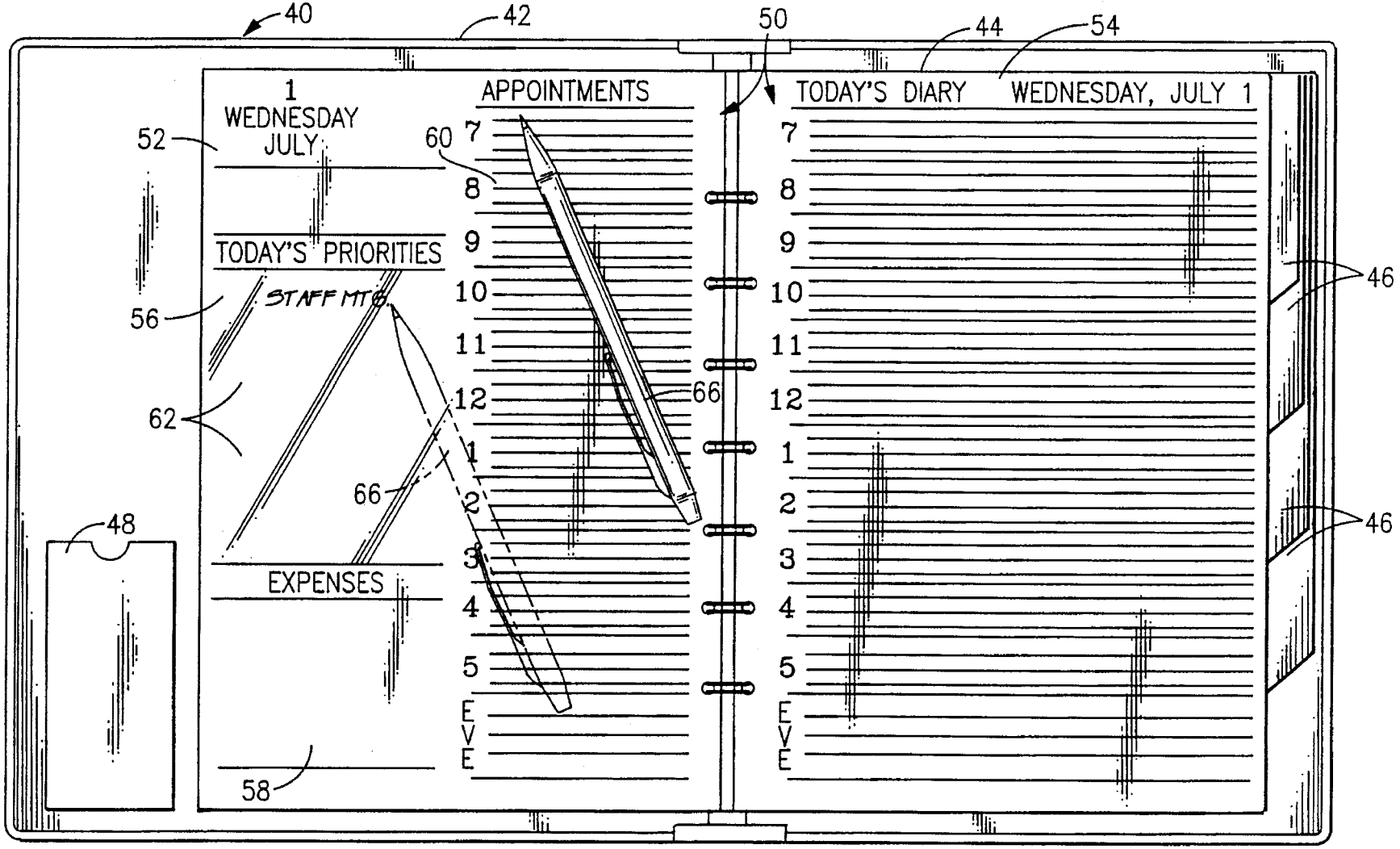
FIG. 2 is a top plan view of a wire bound daily "planner" displaying a two-page record which includes a planning page and a diary page embodying the teachings of the present invention, and showing a writing implement being applied to two entry areas on the planning page in accordance with the present invention.

As shown in FIG. 2, a wire bound daily "planner" 40 comprises a binder 42, pages 44, tabbed dividers 46, and a business card pocket 48. Planner 40 opens up to display a record 50 which comprises a daily planning page 52 and a diary page 54. Planning page 52 includes three adjacently disposed, entry areas: a "Today's Priorities" area 56; an "Expenses" area 58; and a ruled "Appointments" area 60. Area 56 is treated with a reactant composition 62, such as a bleach solution. A writing implement 66 contains a coreactant coloring composition such as an ink formulation of a bleach resistant dye and a bleach sensitive dye.

As shown in FIG. 2, implement 66 is applied to Appointments area 60 to deposit the coreactant composition thereon in the form of information pertaining to scheduled appointments. The coreactant composition exhibits a first marking color in Appointments area 60. Writing implement 66 is also applied to treated area 56 to deposit the coreactant composition thereon in the form of information relating to priority items for the day. As a result of the color changing reaction that takes place on area 56 (i.e., the color contribution of the bleach sensitive dye being destroyed by the bleach solution), the information there is exhibited in the second marking color (i.e., the color contribution of the bleach resistant dye). The information recorded on planning page 52 is thus featured in two contrasting colors and provides a visual aid in locating priority matters as distinguished from other categories of information.

Figure 3:
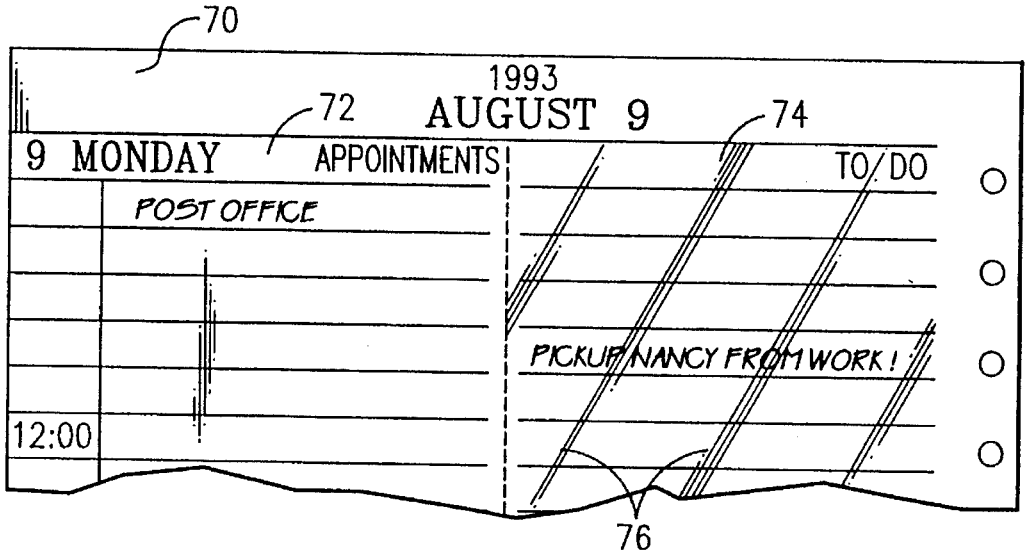
FIG. 3 is a fragmentary plan view of a single-page record having a "To Do" entry area treated with a reactant composition and an "Appointments" entry area.
Figure 4:
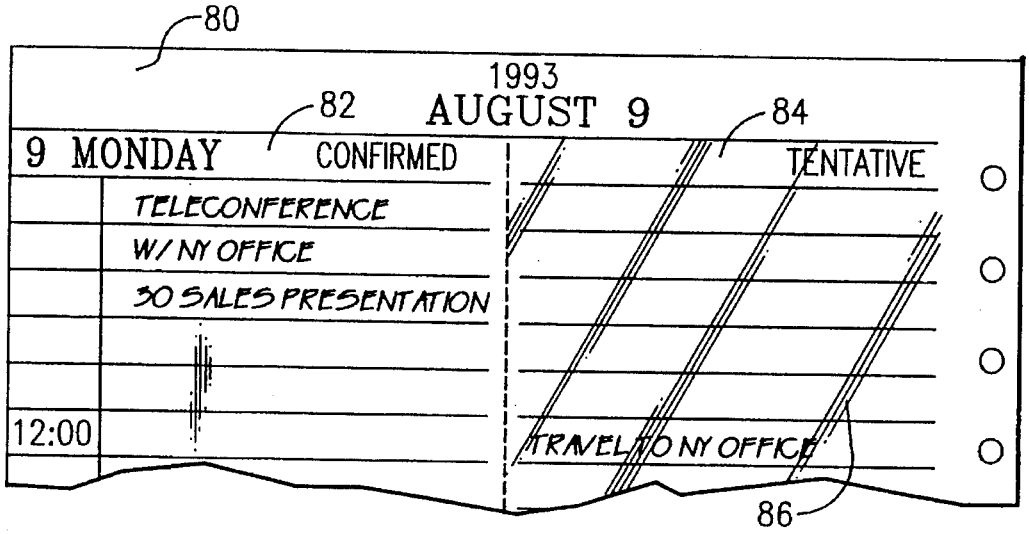
FIG. 4 is a fragmentary plan view of a single-page record having a "Tentative" entry area treated with a reactant composition and a "Confirmed" appointments entry area.
Figure 5:
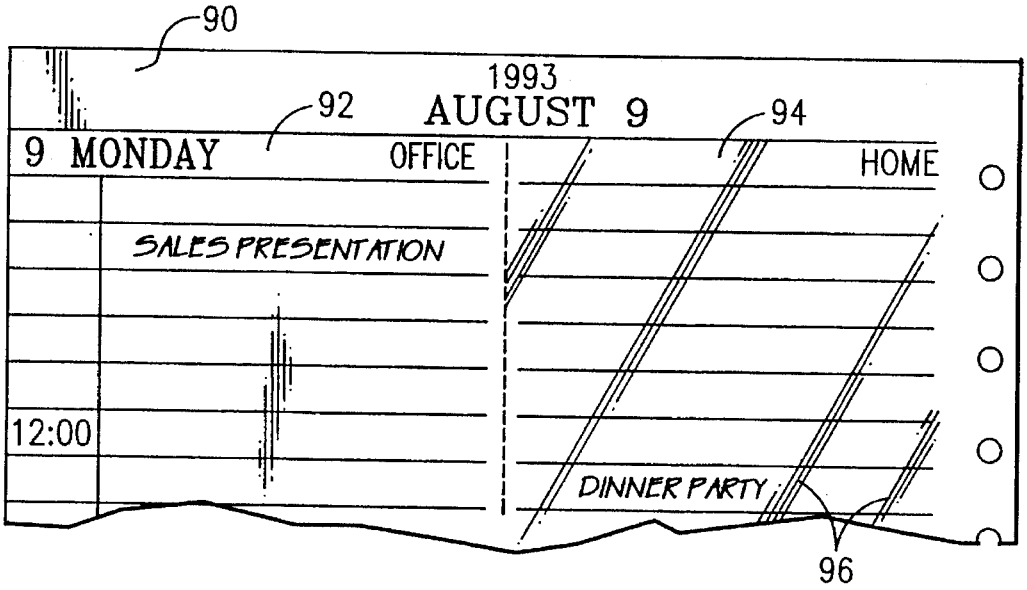
FIG. 5 is a fragmentary plan view of a single-page record having a "Home" appointments entry area treated with a reactant composition and an "Office" appointments entry area.

The system and method of the present invention is further illustrated with reference to FIGS. 3–5. FIGS. 3–5 are fragmentary plan views of a single-page record having two defined record entry areas. FIG. 3 shows a record 70 including an "Appointments" area 72 and a "To Do" list area 74. Area 74 has been treated with a reactant composition 76. In accordance with the present invention, the information on areas 72 and 74 is recorded using a writing implement which contains a coreactant coloring composition. The information recorded on record 70 is thus featured in two contrasting colors and provides a visual aid for distinguishing between scheduled appointments and tasks.

Similarly, FIG. 4 shows a record 80 including a "Confirmed" appointments area 82 and a "Tentative" appointments area 84. Area 84 has been treated with a reactant composition 86. In accordance with the present invention, the information on areas 82 and 84 is recorded using a writing implement which contains a coreactant coloring composition. The information recorded on record 80 is thus featured in two contrasting colors and provides a visual aid for distinguishing between confirmed and tentative appointments.

Similarly, FIG. 5 shows a record 90 including an "Office" appointments area 92 and a "Home" appointments area 94. Area 94 has been treated with a reactant composition 96. In accordance with the present invention, the information on areas 92 and 94 is recorded using a writing implement which contains a coreactant coloring composition. The information recorded on record 90 is thus featured in two contrasting colors and provides a visual aid for distinguishing between office and domestic appointments.

Figure 6:
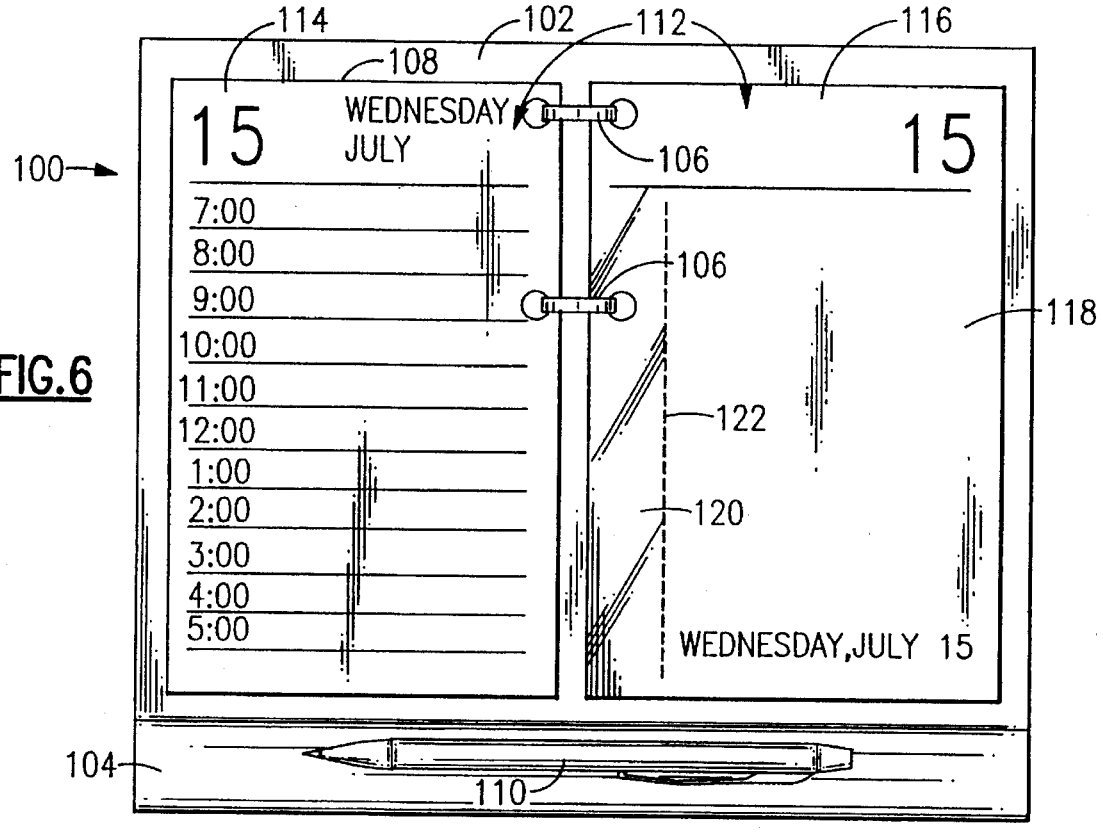
FIG. 6 is a top plan view of a desk calendar displaying a two-page record which includes an appointment page and a note page, wherein the note page has a column area treated with a reactant composition.

Referring to FIG. 6, there is shown another embodiment employing the teachings of the present invention. In FIG. 6, a desk calendar 100 comprises a base 102, a pencil tray 104 and a pair of U-clips 106. Clipped onto base 102 are pages 108. Resting in tray 104 is a writing implement 110, containing a coreactant coloring composition in accordance with the present invention. Pages 108 are opened up to a record 112 which is presented to the user. Record 112 includes a daily planning page 114 and a note page 116. Note page 116 includes a general note area 118, and a column area 120 which has been treated with a reactant composition 122. In accordance with the present invention, implement 110 is utilized to record information on area 118 and on area 120.

Figure 7:
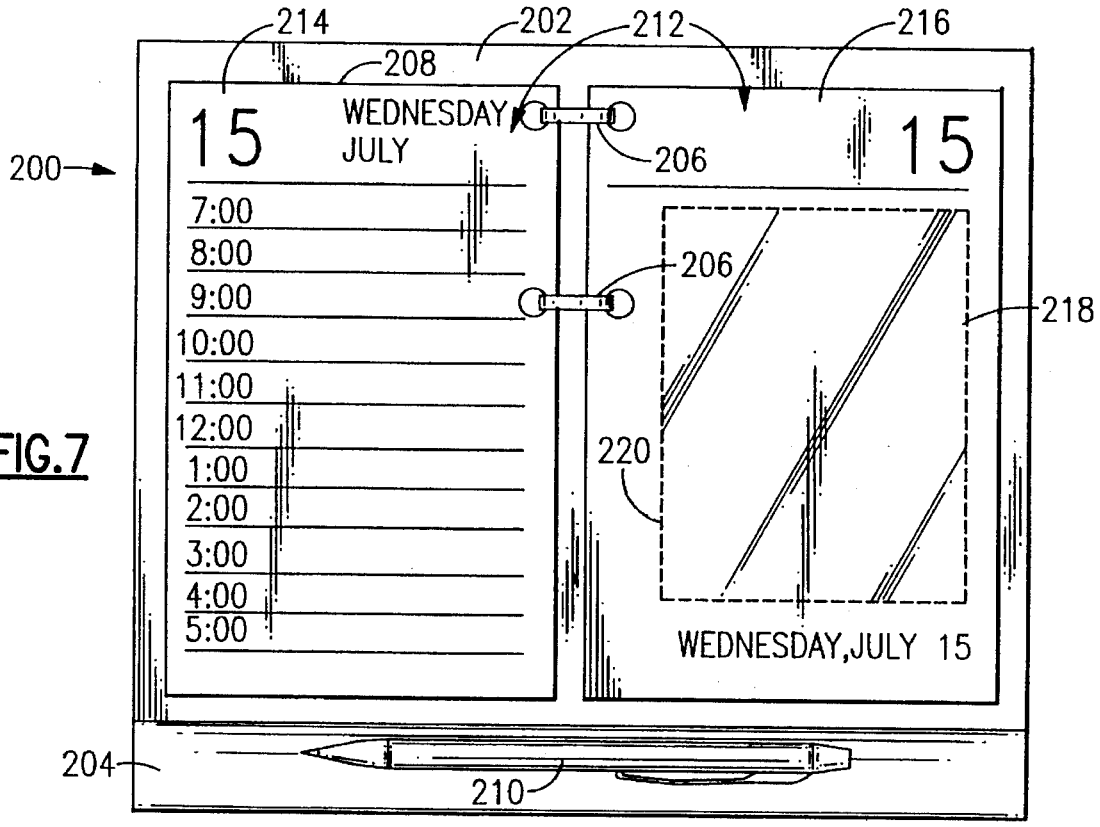
FIG. 7 is a top plan view of a desk calendar displaying a two-page record which includes an appointment page and a note page, wherein the note page has a general area treated with a reactant composition.

For example, area 118 may be used to record items in a "to do" list, and area 120 may be used to enter check marks adjacent to those items in the "to do" list that have been completed. As another example, numbers or other symbols could be written in area 120 to prioritized the various items listed in area 118. In any event, information recorded on note page 116 can be featured in two contrasting colors, providing a visual aid for priority, status and other signaling functions. Similarly, FIG. 7 shows a desk calendar 200, comprising a base 202, a pencil tray 204 and a pair of U-clips 206. Clipped onto base 202 are pages 208. Resting in tray 204 is a writing implement 210, containing a coreactant coloring composition in accordance with the present invention. Pages 208 are opened up to a record 212 which is presented to the user. Record 212 includes a daily planning page 214 and a note page 216. Note page 216 includes a general note area 218 which has been treated with a reactant composition 220. In accordance with the present invention, implement 210 is utilized to record information on page 214 and on area 218 of page 216. For example, treated area 218 may be used to record priority tasks or vital notes in connection with appointments scheduled on page 214. In accordance with the present invention, the information recorded on area 218 will be exhibited in one color and the information recorded on page 214 will be exhibited in another color.

Figure 8:
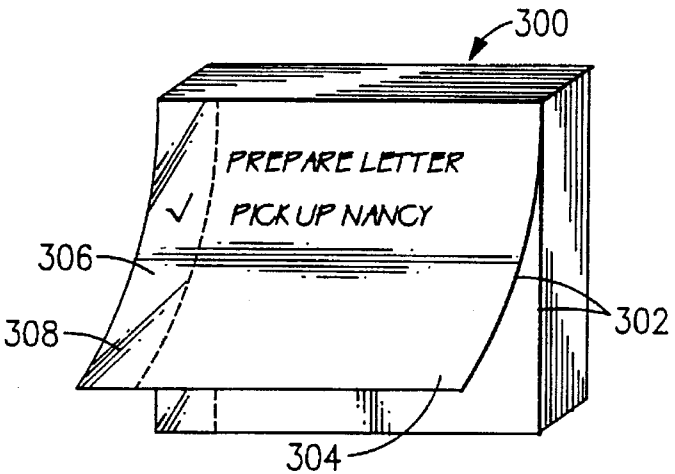
FIG. 8 is a perspective view of a note pad containing adhesive note sheets each of which have a column area treated with a reactant composition.

FIG. 8 illustrates another application of the present invention. A note pad 300 comprises a multiplicity of paper sheets 302, each of which has an adhesive region (not shown) on its back surface, like a POST-IT™ brand note pad ("Post-it" is a trademark of 3M). The front surface of each sheet 302 contains a note area 304 and a column area 306. Area 306 is treated with a reactant composition 308. The resulting article of manufacturer can be employed in the present invention by applying a writing implement, containing a coreactant coloring composition, to sheet 302. The text written on area 304 with the writing implement exhibits a first marking color, and the check mark written on area 306 with the implement exhibits a second marking color after the color-changing reaction occurs. Accordingly, the information recorded on sheet 302 is featured by the contrast between the first and second marking colors.

Figure 9:
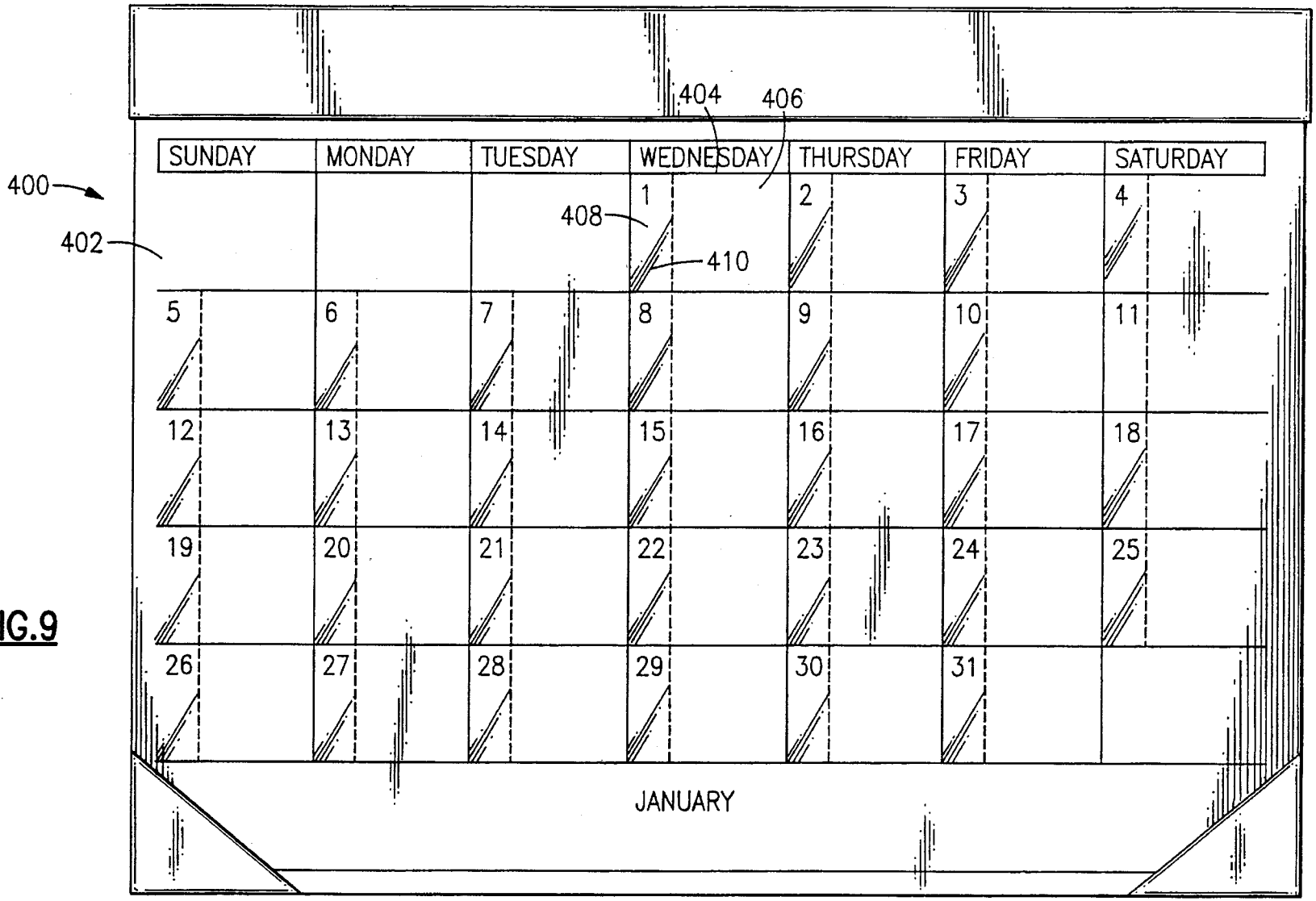
FIG. 9 is a plan view of a calendar which includes an entry area for each day of the month, and each entry area has a column area treated with a reactant composition.

A further application of the present invention is illustrated in FIG. 9. There, a wall calendar 400 contains at least twelve sheets of paper each representing a month in the calendar year. As shown in FIG. 9, a sheet 402 represents the month of January. Sheet 402 is divided into thirty-one record entry areas 404 each representing a day in the month of January. Each entry area 404 contains a note area 406 and a column area 408. Area 408 is treated with a reactant composition 410. In accordance with the present invention, a writing implement containing a coreactant coloring composition is utilized to record information on both areas 406 and 408. Thus, the information recorded on sheet 402 will be featured by the contrast between two marking colors, one exhibited in areas 406 and the other in areas 408.

Figure 11:
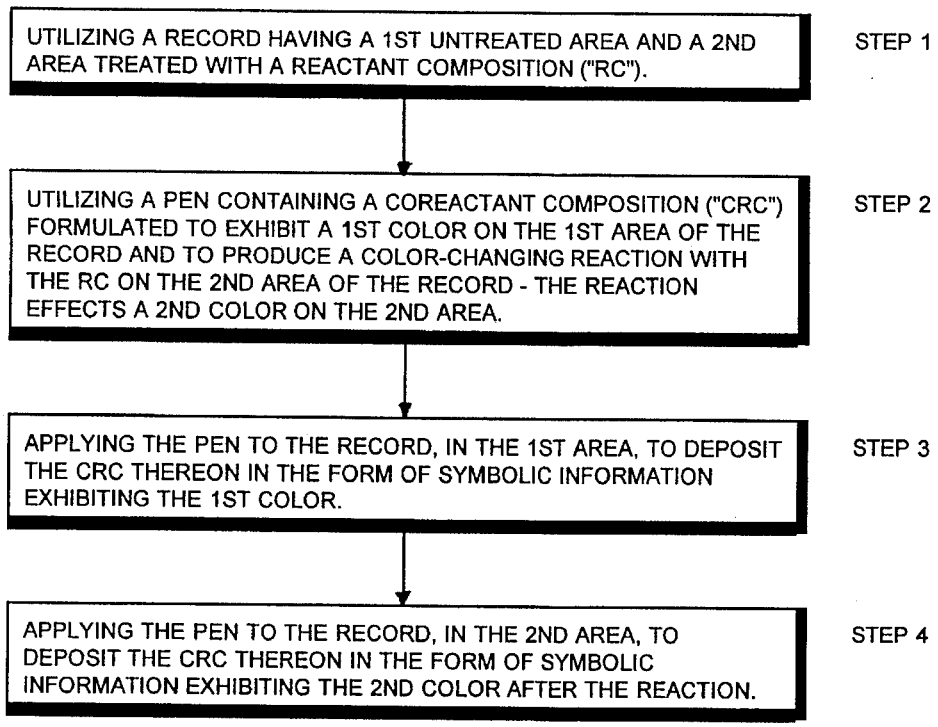
FIG. 11 is a block diagram outlining the preferred method of the present invention.

The preferred method of the present invention is outlined in the block diagram shown in FIG. 11. Step 1 of this method is—utilizing a record having a first untreated area and a second area treated with a reactant composition. Step 2 is—utilizing a pen containing a coreactant composition which is formulated to exhibit a first marking color on the first area of the record, and to produce a color-changing reaction with the reactant composition on the second area of the record—the reaction effects a second color on the second area. Step 3 is—applying the pen to the record, in the first area, to deposit the coreactant composition thereon in the form of symbolic information which exhibits the first color. Step 4 is—applying the pen to the record, in the second area, to deposit the coreactant composition thereon in the form of symbolic information which exhibits the second color after the reaction.

Figure 10:
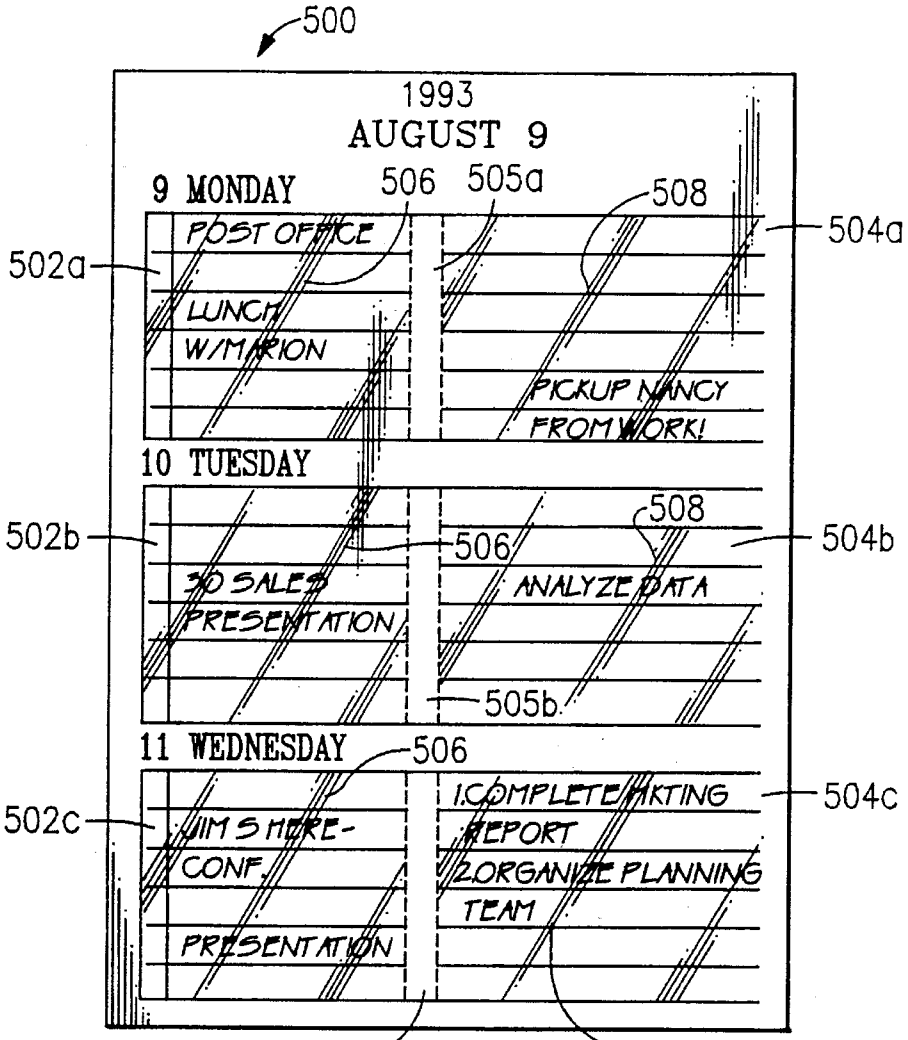
FIG. 10 is a plan view of a planning page with one set of entry areas treated with one reactant composition and another set of entry areas treated with another reactant composition.

Another embodiment of the present invention is illustrated with reference to FIGS. 10 and 12. In FIG. 10, a record 500 is shown in the form of a planning page. Record 500 includes appointment areas 502*a–c*, "to do" list areas 504*a–c*, and column areas 505*a–c*. Areas 502*a–c* are treated with one reactant composition 506, areas 504*a–c* are treated with another reactant composition 508, and areas 505*a–c* are untreated. In accordance with the present invention, the information on areas 502*a–c* and 504*a–c* are recorded using a writing implement containing a coreactant composition which may or may not contain a colorant.

For example, reactant compositions 506 and 508 may be formulated with pH indicators having colorless acid states and colored base states. In such case, reactant compositions 506 and 508 would each contain a different pH indicator that produces a different base color. The coreactant composition would comprise a strong base solution which, upon application to areas 502 and 504, causes the pH indicators to change to their respective base colors. Thus, the written information in areas 502*a–c* will exhibit a first marking color and the written information in areas 504*a–c* will exhibit a second marking color. The information is thus featured on record 500 by the contrast between the first and second marking colors.

In a modification to the above example, the coreactant composition also contains a colorant, resistant to high pH, having a color which is different from the two base colors of the pH indicators. With this arrangement, three colors could be exhibited on record 500, in areas 502, 504 and 505 respectively. That is, entries made in areas 502 would have a color comprising the color contributions of the pH resistant colorant and the base color of pH indicator 506. Entries made in areas 504 would have a color comprising the color contributions of the pH resistant colorant and the base color of pH indicator 508. Finally, entries made in untreated areas 505 would have the color of the pH resistant colorant.

Figure 12:
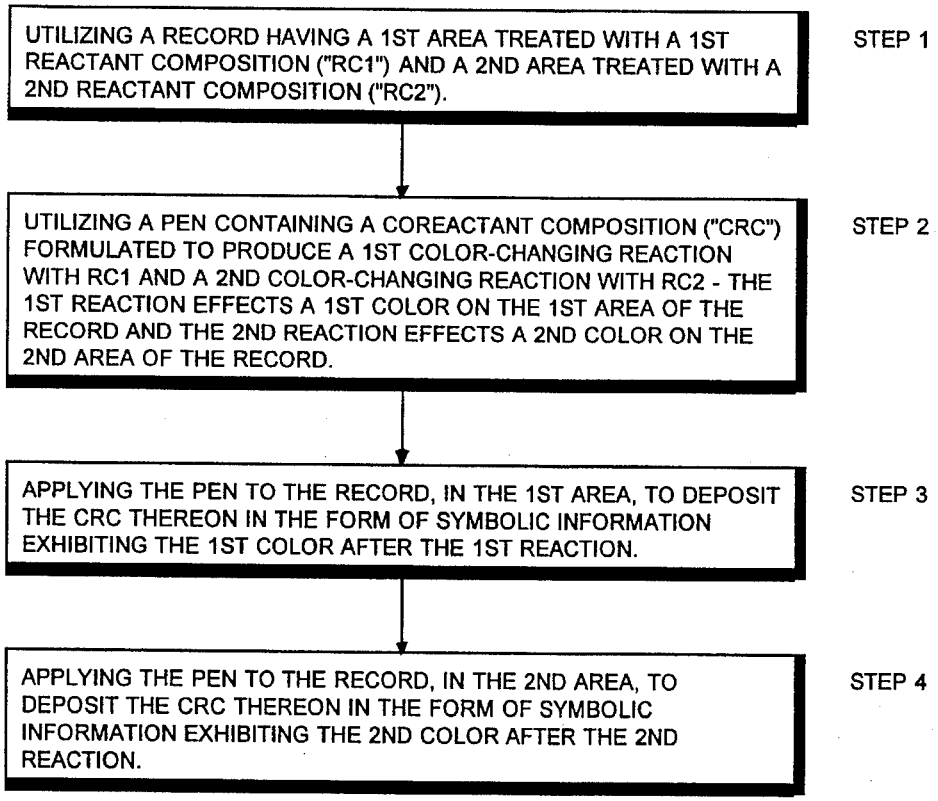
FIG. 12 is a block diagram outlining an alternative method of the present invention.

A method which utilizes a record such as shown in FIG. 10, is outlined in the block diagram of FIG. 12. Step 1 of this method is—utilizing a record having a first area treated with a first reactant composition and a second area treated with a second reactant composition. Step 2 is—utilizing a pen containing a coreactant composition which is formulated to produce a first color-changing reaction with the first reactant composition and a second color-changing reaction with the second reactant composition—the first reaction effects a first marking color on the first area of the record and the second reaction effects a second color on the second area of the record. Step 3 is—applying the pen to the record, in the first area, to deposit the coreactant composition thereon in the form of symbolic information which exhibits the first color after the first reaction. Step 4 is—applying the pen to the record, in the second area, to deposit the coreactant composition thereon in the form of symbolic information which exhibits the second color after the second reaction.

The present invention was first successfully demonstrated using the following materials: (1) Record (or Substrate)—a note pad sheet of paper having a vellum finish, supplied by Keith Clark, Sidney, N.Y. (AT-A-GLANCE® Item: Ruled P21-10); (2) Reactant Composition—a clear solution from a product called CHANGEABLES™, manufactured by Binney & Smith Inc., Easton, Pa., (i.e., from the CHANGEABLES™ "Color Changer" marker); (3) Writing Implement—CHANGEABLES™ color marker; and (4) Coreactant Composition—coloring composition contained in the CHANGEABLES™ color marker.

The CHANGEABLES™ "Color Changer" marker was first applied to the AT-A-GLANCE® paper to lay down a general coating of the clear solution in a column area on the paper (See, e.g., area 26 of page 18 in FIG. 1). After waiting about five seconds for the solution to dry, a CHANGEABLES™ color marker (i.e., "Purple to Coral") was applied to an untreated area on the AT-A-GLANCE® paper (See, e.g., area 24 of page 18 in FIG. 1), and a list of names in a purple color was produced on the untreated area with the marker. The same marker was then applied to the column area coated with the "Color Changer" solution, and a check mark was produced next to one of the names. The check mark almost immediately changed in color from purple to coral. Accordingly, an application of the present invention was demonstrated by utilizing a single writing implement to produce a list in one color and a priority signaling check mark in another color.

A suitable reactant composition for practicing the present invention is a clear bleach solution comprising water, bleach, and a base component. Such solutions are well known and described in German Patent Specification No. 2,724,820 (1979) (hereinafter the "German Patent") and U.S. Pat. No. 5,232,494 to Richard E. Miller (hereinafter the "Miller Patent"). The amount of water present in the bleach solution is typically about 65% by weight of the solution. Suitable bleaches for use in the solution include: hydrogen sulfide; sodium sulfite; sodium pyrosulfite; sodium hypochlorite; and hydrogen peroxide. Concentrations of bleach are from about 5% to about 6% by weight of the solution. Suitable bases which may be employed in the solution include: ammonium hydroxide, sodium hydroxide and sodium carbonate, or combinations thereof. Concentrations of the base are about 7.5% by weight of the solution.

A suitable coreactant composition (designed to work with the bleach solution) is a coloring composition comprising water and a mixture of a bleach sensitive colorant and a bleach resistant colorant. As used herein, the term "colorant" shall include dyes and/or pigments. When such a coreactant coloring composition is applied to a substrate, such as paper, the resulting mark exhibits a color which is the combined color contribution of the bleach sensitive and bleach resistant colorants. When such a coloring composition is applied to an area of the substrate treated with the bleach solution, the bleach eliminates the color contribution of the bleach sensitive colorant. The resulting mark in the treated area exhibits the color of the bleach resistant colorant. Examples of such coloring compositions are disclosed in the German Patent.

The amount of water present in the coreactant coloring composition is typically from about 62% to about 67% by weight of the composition. As taught by the Miller Patent, the water should be deionized water.

A bleach sensitive colorant used in the coreactant coloring composition must be one that is easily destroyed by bleach. Such colorants are typically dyes, and are commonly known in the field. As taught by the Miller Patent, such dyes may include polymethine and azo dyes. Suitable polymethine dyes are marketed under the trade names Astrazon Blue FRR (Basic Blue 69), Astrazon Brilliant Red 4G (Basic Red 14), and Astrazon Pink FBB (Basic Red 49) by Miles(Mobay). Suitable azo dyes include Acid Green 3 by International Dyestuffs Corporation and Acid Violet 19 by International Dyestuffs Corporation as well as combinations thereof. Other examples are disclosed in the German Patent. Concentrations of the bleach sensitive dye in the coreactant coloring composition are from about 2% to about 4%.

A bleach resistant colorant used in the coreactant coloring composition must be one that is highly resistant to bleaching agents. Such colorants typically include dyes and/or pigments, and examples of each are disclosed in the Miller Patent. Examples of suitable dyes include: Pyranine 120 marketed by Miles(Mobay), Acid Red 52 marketed by Carolina Color, Food Red 14 marketed by Hilton-Davis (also called FD&C Red No. 3, and sold under the trade names Erythrosine and Erythrosine Bluish), Basantol Green 910 marketed by BASF, Acid Red 87 marketed by Hilton-Davis (also called D & C Red No. 22 by the FDA, and sold under the trade names Eosine YS and Eosine G), Acid Red 92 marketed by International Dyestuffs Corporation (also called D & C Red No. 28 by the FDA, and sold under the trade name Phloxine B). Other examples of bleach resistant dyes are disclosed in the German Patent. Concentrations of bleach resistant dyes in the coreactant coloring composition are from about 1% to about 4.5%.

The above-described bleach solution (reactant composition) and coloring composition (coreactant composition) may also include a humectant which functions to prevent the compositions from becoming brittle when applied to a substrate such as paper. Also, a humectant protects against premature drying of the coloring composition in a capillary marking system, such as a bonded fiber marking nib. Suitable humectants for the bleach solution and coloring composition are polyhydric alcohols such as ethylene glycol, propylene glycol, di-propylene glycol, hexylene glycol and polyethylene glycol, and hydroxylated starches. The German Patent suggests concentrations of the humectant of about 30% by weight for the coreactant coloring composition and about 22% by weight for the bleach solution (reactant composition). U.S. Pat. No. 4,889,559 to Goldberg et al. (hereinafter "the Goldberg Patent") suggests that the humectant concentration for the reactant composition could be as low as from about 4% to about 6%.

The above-described bleach solution (reactant composition) and coloring composition (coreactant composition) may also include a drying agent and a preservative. Suitable drying agents and preservatives are identified and described in the Miller Patent.

In accordance with the present invention, a record may comprise one or more separate substrate pieces, as illustrated in FIGS. 1–2 and 6–7. Each piece is constructed of a suitable substrate material, preferably comprising paper. In a preferred embodiment of the invention, which employs a bleach solution as the reactant composition and bleach sensitive/resistant colorants as a coreactant composition, it is believed that the type of paper used is not critical. Satisfactory results have been achieved using a plain bond paper and a paper having a vellum finish (Weight 50#; Brightness 90–93; and Opacity 92) sold under the brand name Cougar Opaque Vellum.

The reactant composition may be applied to the substrate material by conventional printing methods, or by other coating processes such as roller coating, blade coating, air-knife coating, or brush coating. A film forming agent, such as described in the Goldberg Patent, may be included in the reactant composition for adjusting the viscosity and film forming properties of the composition, as required, when applying the composition to the substrate material.

The coreactant coloring composition can be contained in conventional writing implements such as markers or pens using bonded fiber or centered plastic nibs, or roller balls.

It is to be understood that the reactant and coreactant compositions, utilized to practice the present invention, are not limited to the preferred compositions described hereinabove. The reactant composition may comprise any substance which can be used in connection with a substrate material and take part in a color-changing reaction to achieve the objectives of the present invention. The coreactant composition may comprise any substance which reacts with the reactant composition in a color-changing reaction, and which can be dispensed from a writing implement.

For example, the reactant composition may include a pH sensitive indicator, such as phenolphthalein, thymolphthalein, phenolsulfonphthalein (phenol red), bromthymol blue and methyl orange. The coreactant composition may include a pH resistant colorant and a base solution having sufficient pH to cause the pH sensitive indicator (reactant composition) to react and produce its base color. PH sensitive indicator inks are well known and disclosed in the Goldberg Patent and in U.S. Pat. No. 5,139,572 to Kawashima.

In another example, the reactant composition may include a Redox indicator such as ortho-Tolidine, Dichloroindophenol, and Methylene Blue. The coreactant composition may include an appropriate oxidizer, such as bleach or hydrogen peroxide, and an oxidation resistant colorant. Redox indicator inks are well known and disclosed in the Goldberg Patent.

In a further example, the reactant composition may include a complexiometric ingredient such as o-phenanthroline, dimethylglyoxime and Tiron. The coreactant composition may include an appropriate metal salt solution, such as a buffered ferrous-ferric ion solution, and a compatible colorant. Complexiometric inks are well known and disclosed in the Goldberg Patent.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

For example, the reactant composition could comprise a strong base solution, and the coreactant composition could comprise a pH indicator having a characteristic "acid color" and a characteristic "base color." In another example, the reactant composition could comprise a strong base solution; and the coreactant composition could comprise a pH resistant colorant, and a pH sensitive indicator having a colorless acid state and a colored base state. In yet another example, the reactant composition could contain a strong base solution, and the coreactant composition could comprise two pH sensitive indicators, one of which exhibits an acid color and the other a colorless acid state, and each exhibits a different base color.

In a further example, two different reactant compositions could be employed to realize two or three different colored entries using a single writing implement, as illustrated in and described with respect to FIG. 10. Extending this example even further, more than two reactant compositions could be employed on the record to realize three or more different colored entries on a record using a single writing implement.

In yet a further example, a record could comprise a first substrate area that has a relatively high characteristic pH level, and a second substrate area that has a relatively low characteristic pH level. In this case, the reactant composition would constitute the substances in the first substrate area that produce the relatively high pH condition. The coreactant composition could include, for example, a pH indicator having both an acid color and a base color. In such case, the pH indicator would be selected and/or regulated to produce its acid color on the second substrate area and its base color on the first substrate area. This embodiment can be illustrated with reference to FIG. 1. In FIG. 1, note pad page 18 could be constructed of a paper having a high pH, and planning pages 14 and 16 could be constructed of a paper having a low pH. Writing implement 30 could contain a pH indicator composition having acid and base colors. In this example, the pH indicator composition would be formulated to produce its acid color on pages 14 and 16, and its base color on page 18.

What is claimed is:

1. A system for featuring information on a record, comprising:

a record having first and second areas disposed adjacent to each other, the second area being treated with a reactant composition;

a coreactant composition, formulated to exhibit a first marking color on the first area of said record without a color-changing reaction and to exhibit a second marking color on the second area of said record after a color-changing reaction with the reactant composition on the second area, said first marking color being sufficiently different from said second marking color such that one can be contrasted with the other after the coreactant composition has been applied to the reactant composition; and writing implement means, containing said coreactant composition, for depositing said coreactant composition on the first and the second areas in the form of symbolic information, the information in the first area exhibiting the first marking color, and the information in the second area exhibiting the second marking color after the color-changing reaction, whereby the information is featured on said record by the contrast between the first marking color and the second marking color.

2. A system as recited in claim 1, wherein said reactant composition contains a bleach solution, and said coreactant composition is a coloring composition containing a mixture of a bleach sensitive colorant and a bleach resistant colorant.

3. A system as recited in claim 2, wherein said bleach solution contains water, bleach and a base, and said coloring composition further contains water.

4. A system as recited in claim 3, wherein the bleach sensitive colorant of said coloring composition is a bleach sensitive dye selected from the group consisting of polymethine dyes and azo dyes; and wherein the bleach resistant colorant of said coloring composition is selected from the group consisting of Pyranine 120, Acid Red 52, Food Red 14, Basantol Green 910, Acid Red 87, Acid Red 92, pigments, and mixtures thereof.

5. A system as recited in claim 3, wherein the bleach of said bleach solution is selected from the group consisting of hydrogen sulfide, sodium sulfite, sodium pyrosulfite, sodium hypochlorite, and hydrogen peroxide.

6. A system as recited in claim 3, wherein the base of said bleach solution is selected from the group consisting of ammonium hydroxide, sodium hydroxide and sodium carbonate, or combinations thereof.

7. A system as recited in claim 1, wherein said reactant composition contains a pH sensitive indicator solution, and said coreactant composition is a coloring composition containing a pH resistant colorant and a base solution.

8. A system as recited in claim 1, wherein said reactant composition contains a base solution, and said coreactant composition is a coloring composition containing a pH resistant colorant and a pH sensitive indicator solution.

9. A system as recited in claim 1, wherein said reactant composition contains a base solution, and said coreactant composition contains a pH indicator having a characteristic acid color and a characteristic base color.

10. A system as recited in claim 1, wherein said reactant composition contains a base solution, and said coreactant composition contains at least two pH sensitive indicators.

11. A system as recited in claim 10, wherein one of said pH indicators has an acid color and another of said pH indicators has a colorless acid state, the one and the other pH indicators each having a characteristic base color.

12. A system as recited in claim 1, wherein said reactant composition contains a Redox indicator solution, and said coreactant composition is a coloring composition containing an oxidation resistant colorant and an appropriate oxidizer.

13. A system as recited in claim 1, wherein said reactant composition contains a complexiometric ingredient, and said coreactant composition is a coloring composition containing a compatible colorant and an appropriate metal salt solution.

14. A system as recited in claim 1, wherein said record includes a single substrate.

15. A system as recited in claim 14, wherein said one piece of substrate material is a sheet of paper.

16. A system as recited in claim 1, wherein said record includes a plurality of substrates, the first area of said record being situated on one of said plurality of substrates, and the second area of said record being situated on another of said plurality of substrates.

17. A system as recited in claim 16, wherein each of said plurality of pieces of substrate material is a sheet of paper.

18. A system as recited in claim 1, wherein said symbolic information is in the form of text.

19. A system as recited in claim 1, wherein said symbolic information is in the form of at least one check mark.

20. A system as recited in claim 1, wherein said writing implement means is a pen having a bonded fiber nib.

21. A system as recited in claim 1, wherein said writing implement means is a pen having a roller ball tip.

22. A method of featuring information on a record with a writing implement, comprising the steps of:

utilizing a record which has first and second areas disposed adjacent to each other, the second area being treated with a reactant composition;

utilizing a writing implement containing a coreactant composition, said coreactant composition being formulated to exhibit a first marking color on the first area of said record without a color-changing reaction and to exhibit a second marking color on the second area of said record after a color-changing reaction with the reactant composition on the second area, said first marking color being sufficiently different from said second marking color such that one can be contrasted with the other after the coreactant composition has been applied to the reactant composition;

applying said writing implement to the record, in the first area, to deposit the coreactant composition thereon in the form of symbolic information which exhibits the first marking color; and applying said writing implement to the record, in the second area, to deposit the coreactant composition thereon in the form of symbolic information which exhibits the second marking color after the color-changing reaction, whereby the information is featured on said record by the contrast between the first marking color and the second marking color.

23. A system for featuring information on a record, comprising:

a record including first and second substrate areas disposed adjacent to each other, the second substrate area having a characteristic pH level;

a coreactant composition formulated to exhibit a first marking color on the first substrate area of said record and to produce a color-changing reaction upon contact with the second substrate area, said coreactant composition containing a pH indicator which participates in the color-changing reaction with the second substrate area to effect a second marking color on the second substrate area; and writing implement means, containing said coreactant composition, for depositing said coreactant composition on the first and the second substrate areas in the form of symbolic information, the information in the first area exhibiting the first marking color, and the information in the second area exhibiting the second marking color after the color-changing reaction, whereby the information is featured on said record by the contrast between the first marking color and the second marking color.

24. A method of featuring information on a record with a writing implement, comprising:

utilizing a record which includes first and second substrate areas disposed adjacent to each other, the second substrate area having a characteristic pH level;

utilizing a writing implement containing a coreactant composition, said coreactant composition being formulated to exhibit a first marking color on the first substrate area of said record and to produce a color-changing reaction upon contact with the second substrate area, said coreactant composition containing a pH indicator which participates in the color-changing reaction with the second substrate area to effect a second marking color on the second substrate area; and applying said writing implement to the record, in the first substrate area, to deposit said coreactant composition thereon in the form of symbolic information which exhibits the first marking color; and applying the writing implement to the record, in the second substrate area, to deposit said coreactant composition thereon in the form of symbolic information which exhibits the second marking color after the color-changing reaction, whereby the information is featured on said record by the contrast between the first marking color and the second marking color.

* * * * *